US012516904B2

(12) United States Patent
McPherson et al.

(10) Patent No.: US 12,516,904 B2
(45) **Date of Patent: *Jan. 6, 2026**

(54) ARCHERY BOW WITH WIDE RATIO LIMB

(71) Applicant: MCP IP, LLC, Sparta, WI (US)

(72) Inventors: Mathew A. McPherson, Norwalk, WI (US); Jeffrey A Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/733,734

(22) Filed: Jun. 4, 2024

(65) Prior Publication Data

US 2024/0328744 A1 Oct. 3, 2024

Related U.S. Application Data

(63) Continuation of application No. 18/115,650, filed on Feb. 28, 2023, now Pat. No. 12,000,669, which is a continuation of application No. 17/238,941, filed on Apr. 23, 2021, now Pat. No. 11,592,257, which is a continuation of application No. 15/893,501, filed on Feb. 9, 2018, now Pat. No. 10,989,491.

(60) Provisional application No. 62/457,775, filed on Feb. 10, 2017.

(51) Int. Cl.
*F41B 5/12* (2006.01)
*F41B 5/10* (2006.01)

(52) U.S. Cl.
CPC ..... *F41B 5/123* (2013.01); *F41B 5/10* (2013.01); *F41B 5/105* (2013.01)

(58) Field of Classification Search
CPC .... F41B 5/10; F41B 5/105; F41B 5/12; F41B 5/123; F41B 5/14; F41B 5/1403
USPC ..... 124/25, 25.6, 86, 900
See application file for complete search history.

(56) References Cited

U.S. PATENT DOCUMENTS

| | | | |
|---|---|---|---|
| 1,192,639 | A | 7/1916 | Hunholz |
| 1,526,176 | A | 2/1925 | O'Connell |
| 1,689,141 | A | 10/1928 | Keller |
| 2,786,461 | A | 3/1957 | Pelsue, Jr. |
| 3,486,495 | A | 12/1969 | Allen |
| 3,851,638 | A | 12/1974 | Alexander |
| 3,923,035 | A | 12/1975 | Trotter |
| 3,945,368 | A | 3/1976 | Jones |
| 3,958,551 | A | 5/1976 | Ketchum |

(Continued)

FOREIGN PATENT DOCUMENTS

KR 860001808 8/1986

OTHER PUBLICATIONS

Crisbow Crossbow Catalog by Crisbow Crossbow.
Mar./Apr. 1987 Mother Earth News Magazine, Issue No. 104.

*Primary Examiner* — Alexander R Niconovich
(74) *Attorney, Agent, or Firm* — Laabs Intellectual Property

(57) ABSTRACT

In some embodiments, an archery bow comprises a frame, a first limb assembly supporting a first rotatable member and a second limb assembly supporting a second rotatable member. The first rotatable member comprises a cam. A bowstring extends between the first rotatable member and the second rotatable member. A power cable is in communication with the cam. The first limb assembly has a width and a length, wherein the width is at least 26% of the length. In some embodiments, the width is at least 28% of the length.

20 Claims, 14 Drawing Sheets

(56) References Cited

U.S. PATENT DOCUMENTS 3,987,777 A 10/1976 Darlington
3,993,039 A 11/1976 Groves et al.
4,027,645 A 6/1977 Damron
4,041,927 A 8/1977 Van House
4,077,385 A 3/1978 Fredrickson
4,086,901 A 5/1978 Clement
4,134,383 A 1/1979 Flood
4,169,453 A 10/1979 Hunsicker
4,169,456 A 10/1979 Van House
4,201,177 A 5/1980 Holmen et al.
4,246,883 A 1/1981 Ash
4,261,320 A 4/1981 Barna
4,290,407 A 9/1981 Damron
4,291,664 A 9/1981 Nishioka
4,337,749 A 7/1982 Barna
4,343,286 A 8/1982 Thacker
4,350,138 A * 9/1982 Caldwell ..... F41B 5/10 124/86
4,385,618 A 5/1983 Nishioka
4,388,914 A * 6/1983 Cesin ..... F41B 5/12 124/40
4,438,753 A * 3/1984 Simonds ..... F41B 5/10 124/25.6
4,446,844 A 5/1984 Nishioka
4,458,657 A 7/1984 Stockmar
4,461,267 A 7/1984 Simonds et al.
4,478,202 A 10/1984 Anderson
4,512,326 A 4/1985 Jarrett
4,644,929 A * 2/1987 Peck ..... F41B 5/10 124/23.1
4,649,891 A 3/1987 Bozek
4,651,707 A 3/1987 Bozek
4,667,649 A 5/1987 Humphrey
4,693,229 A 9/1987 Nishioka
4,722,317 A 2/1988 Hartwig
4,766,874 A 8/1988 Nishioka
4,827,893 A 5/1989 Nishioka
4,903,677 A 2/1990 Colley et al.
4,947,822 A 8/1990 Jones
4,971,020 A 11/1990 Soderstrom et al.
5,031,599 A 7/1991 Cruise
5,054,463 A 10/1991 Colley et al.
5,062,406 A 11/1991 Robertson
5,119,797 A * 6/1992 Anderson ..... F41B 5/143 124/44.5
5,150,699 A 9/1992 Boissevain
5,205,268 A * 4/1993 Savage ..... F41B 5/14 124/44.5
5,205,269 A 4/1993 Guzzetta
5,243,957 A * 9/1993 Neilson ..... F41B 5/1469 124/31
5,353,777 A 10/1994 Fincher
5,368,006 A 11/1994 McPherson
5,373,831 A 12/1994 Cushman
5,381,777 A 1/1995 Mitchell et al.
5,429,106 A * 7/1995 Martin ..... F41B 5/0026 124/23.1
5,503,135 A 4/1996 Bunk
5,623,915 A 4/1997 Kudlacek
5,638,804 A 6/1997 Remick et al.
5,649,519 A * 7/1997 Linderman ..... F41B 5/143 124/24.1
5,657,739 A 8/1997 Smith
5,697,355 A * 12/1997 Schaffer ..... F41B 5/10 124/86
5,720,268 A 2/1998 Koltze
5,722,380 A * 3/1998 Land ..... F41B 5/10 124/23.1
5,809,982 A 9/1998 McPherson
5,894,835 A * 4/1999 Simonds ..... F41B 5/10 264/157
5,901,692 A * 5/1999 Allshouse ..... F41B 5/105 124/23.1
5,921,227 A * 7/1999 Allshouse ..... F41B 5/105 124/86
5,975,067 A 11/1999 Strother
5,979,425 A 11/1999 Loomis
5,996,566 A 12/1999 Malan
6,022,660 A 2/2000 Uno
6,055,974 A 5/2000 Dieziger
6,142,132 A 11/2000 Simonds
6,216,671 B1 4/2001 Dougherty et al.
6,267,108 B1 7/2001 McPherson et al.
6,371,098 B1 * 4/2002 Winther ..... F41B 5/10 124/44.5
6,588,411 B1 * 7/2003 Simonds ..... F41B 5/0063 264/157
6,651,641 B1 11/2003 Bower et al.
6,698,413 B1 3/2004 Ecklund
6,758,204 B1 * 7/2004 Goff ..... F41B 5/1415 124/25.6
6,776,148 B1 * 8/2004 Islas ..... F41B 5/105 124/25.6
6,792,931 B1 * 9/2004 Schaar ..... F41B 5/10 124/25.6
6,871,643 B2 3/2005 Cooper
6,990,970 B1 * 1/2006 Darlington ..... F41B 5/10 124/900
6,994,079 B1 2/2006 Darlington
7,047,958 B1 * 5/2006 Colley ..... F41B 5/10 124/25.6
7,059,315 B2 6/2006 Blahnik
7,201,161 B1 4/2007 York
7,204,242 B2 * 4/2007 Dziekan ..... F41B 5/1469 124/25
7,305,979 B1 12/2007 Yehle
7,308,890 B1 * 12/2007 Wheeler ..... F41B 5/105 124/23.1
7,328,693 B2 * 2/2008 Kempf ..... F41B 5/123 124/25
7,347,196 B1 3/2008 Shepley, Jr. et al.
7,363,921 B2 * 4/2008 Kempf ..... F41B 5/105 124/25
7,441,555 B1 * 10/2008 Larson ..... F41B 5/10 124/25.6
7,506,643 B2 3/2009 Holmberg
7,578,289 B2 * 8/2009 Norkus ..... F41B 5/10 124/44.5
7,624,725 B1 12/2009 Choma
7,637,256 B2 * 12/2009 Lee ..... F41B 5/10 124/25.6
7,699,045 B1 * 4/2010 Kronengold ..... F41B 5/10 124/25.6
7,721,721 B1 5/2010 Kronengold
7,784,452 B1 * 8/2010 Kronengold ..... F41B 5/10 124/23.1
7,823,572 B2 * 11/2010 Anderson ..... F41B 5/143 124/25
7,832,387 B1 11/2010 Yehle
7,891,348 B2 * 2/2011 Colley ..... F41B 5/105 124/25
7,938,109 B1 * 5/2011 Larson ..... F41B 5/10 124/25.6
7,980,236 B1 7/2011 Kronengold
7,997,259 B2 8/2011 Wilson
8,020,544 B2 * 9/2011 McPherson ..... F41B 5/10 124/23.1
8,056,548 B1 * 11/2011 Larson ..... F41B 5/1426 124/90
8,069,847 B2 * 12/2011 Blosser ..... F41B 5/10 124/88
8,079,353 B2 12/2011 Davis
8,205,607 B1 6/2012 Darlington
8,281,774 B2 * 10/2012 Grace ..... F41B 5/10 124/900
8,360,044 B2 1/2013 Platt
8,387,603 B2 * 3/2013 Darlington ..... F41B 5/105 124/25
8,387,604 B1 * 3/2013 Terzo ..... F41B 5/123 124/25

(56) References Cited

U.S. PATENT DOCUMENTS 8,443,791 B2 * 5/2013 Miller ..... F41B 5/105 124/25.6
8,448,630 B1 * 5/2013 McPherson ..... F41B 5/00 124/25
8,459,244 B2 * 6/2013 Yehle ..... F41B 5/0094 124/23.1
8,469,013 B1 * 6/2013 Obteshka ..... F41B 5/105 124/90
8,622,050 B2 * 1/2014 Goff ..... F41B 5/12 124/35.2
8,627,810 B2 * 1/2014 McPherson ..... F41B 5/105 124/23.1
8,627,811 B1 1/2014 Darlington
8,651,095 B2 * 2/2014 Islas ..... F41B 5/123 124/900
8,683,989 B1 * 4/2014 McPherson ..... F41B 5/10 124/900
8,746,220 B2 * 6/2014 McPherson ..... F41B 5/105 124/25.6
8,776,770 B2 * 7/2014 Batdorf ..... F41B 5/1403 124/88
8,844,508 B2 * 9/2014 Sims ..... F41B 5/123 124/25
8,851,056 B2 * 10/2014 Trpkovski ..... F41B 5/123 124/25
8,991,375 B2 * 3/2015 McPherson ..... F41B 5/105 124/24.1
9,022,013 B2 * 5/2015 Trpkovski ..... F41B 5/14 124/87
9,091,503 B2 * 7/2015 Howard ..... F41B 5/10
9,115,953 B1 * 8/2015 Huang ..... F41B 5/105
9,140,513 B2 * 9/2015 Trpkovski ..... F41B 5/0031
9,194,643 B2 * 11/2015 Biafore, Jr. ..... F41B 5/1403
9,200,863 B2 12/2015 Bednar
9,273,921 B2 * 3/2016 Koch ..... F41B 5/10
9,273,922 B2 * 3/2016 Hudkins ..... F41B 5/123
9,297,604 B1 * 3/2016 Sidebottom ..... F41B 5/105
9,303,945 B1 4/2016 Hughes et al.
9,310,155 B2 * 4/2016 Langley ..... F41B 5/105
D755,302 S 5/2016 Jansen
9,347,731 B1 * 5/2016 Chang ..... F41B 5/123
9,513,079 B1 * 12/2016 Missel ..... F41B 5/143
9,528,788 B2 * 12/2016 McPherson ..... F41B 5/14
9,581,406 B1 * 2/2017 Nevels ..... F41B 5/0026
9,671,189 B2 * 6/2017 McPherson ..... F41B 5/123
9,683,806 B1 * 6/2017 Yehle ..... F41B 5/105
9,746,275 B1 * 8/2017 Popov ..... F41B 5/105
9,921,026 B1 * 3/2018 Anderson ..... F41B 5/1469
9,933,225 B2 4/2018 Yehle et al.
10,048,036 B1 * 8/2018 Kempf ..... F41B 5/105
10,082,358 B2 * 9/2018 McPherson ..... F41B 5/105
10,126,088 B2 * 11/2018 Yehle ..... F41B 5/105
10,184,749 B2 * 1/2019 Trpkovski ..... F41B 5/10
10,240,890 B2 * 3/2019 Trpkovski ..... F41B 5/12
10,254,075 B2 * 4/2019 Yehle ..... F41B 5/143
10,267,592 B2 * 4/2019 Bartels ..... F41B 5/123
10,330,427 B2 * 6/2019 Shaffer ..... F41B 5/123
10,371,480 B1 * 8/2019 Huang ..... F41B 5/10
10,386,151 B2 * 8/2019 McPherson ..... F41B 5/10
10,458,742 B1 * 10/2019 Kempf ..... F41B 5/123
10,495,404 B2 * 12/2019 Shaffer ..... F41B 5/1469
10,502,517 B1 * 12/2019 Ellis, Jr. ..... F41B 5/0094
10,527,382 B2 * 1/2020 Trpkovski ..... F41B 5/10
10,612,882 B2 * 4/2020 McPherson ..... F41B 5/10
10,627,185 B2 * 4/2020 Marriott ..... F41B 5/123
10,627,186 B2 * 4/2020 Chang ..... F41B 5/123
10,746,497 B2 * 8/2020 Shaffer ..... F41B 5/123
10,969,191 B2 * 4/2021 Wong ..... F41B 5/14
10,989,491 B2 4/2021 McPherson et al.
11,143,483 B2 * 10/2021 Marriott ..... F41B 5/1403
11,226,166 B2 * 1/2022 Gann ..... F41B 5/00
11,592,257 B2 2/2023 McPherson et al.
11,656,056 B2 * 5/2023 McPherson ..... F41B 5/10 124/25.6
2007/0044782 A1 3/2007 Norkus
2007/0101980 A1 * 5/2007 Sims ..... F41B 5/105 124/25.6
2007/0104980 A1 5/2007 Kim et al.
2009/0101126 A1 4/2009 Anderson
2009/0188482 A1 * 7/2009 Strother ..... F41B 5/1411 124/88
2009/0223500 A1 9/2009 Stanziale
2009/0288650 A1 11/2009 Batdorf
2010/0000504 A1 1/2010 Trpkovski
2010/0170488 A1 * 7/2010 Rasor ..... F41C 23/00 124/35.1
2010/0224177 A1 9/2010 Kaylan
2010/0281751 A1 11/2010 Humpert
2011/0041820 A1 * 2/2011 Stanziale ..... F41B 5/105 124/25
2011/0056467 A1 * 3/2011 Popov ..... F41B 5/10 124/25.6
2011/0203563 A1 8/2011 Platt
2012/0006310 A1 1/2012 Sims
2012/0006311 A1 1/2012 Bednar
2012/0298087 A1 11/2012 Trpkovski
2013/0061839 A1 * 3/2013 Asherman ..... F41B 5/10 124/31
2013/0074819 A1 * 3/2013 McPherson ..... F41B 5/105 124/25.6
2015/0136105 A1 5/2015 McPherson et al.
2015/0153131 A1 6/2015 Trpkovski
2015/0345891 A1 * 12/2015 McPherson ..... F41B 5/1411 124/25.6
2017/0108308 A1 * 4/2017 McPherson ..... F41B 5/1403
2017/0122690 A1 5/2017 Missel
2017/0122694 A1 * 5/2017 Achkar ..... F41B 5/10
2017/0370673 A1 * 12/2017 Yehle ..... F41B 5/10
2018/0135935 A1 5/2018 McPherson
2018/0224237 A1 8/2018 McPherson
2020/0011632 A1 * 1/2020 Chang ..... F41B 5/105
2020/0408481 A1 * 12/2020 Chang ..... F41B 5/123
2024/0167783 A1 * 5/2024 Nebergall ..... F41B 5/105

* cited by examiner

ARCHERY BOW WITH WIDE RATIO LIMB

CROSS-REFERENCE TO RELATED APPLICATIONS

This application claims the benefit of U.S. patent application Ser. No. 18/115,650, filed Feb. 28, 2023, which claims the benefit of U.S. patent application Ser. No. 17/238,941, filed Apr. 23, 2021, which claims the benefit of U.S. patent application Ser. No. 15/893,501, filed Feb. 9, 2018, which claims the benefit of U.S. Patent Application No. 62/457,775, filed Feb. 10, 2017, the entire contents of each of which are hereby incorporated herein by reference.

BACKGROUND OF THE INVENTION

This invention relates to archery bows, which are generally known in the art.

Archery bows typically use flexible limbs to store energy. The limbs can be highly stressed members. In some bows, the limbs are highly stressed even when the bow is at-rest, and the stress increases when the bow is drawn.

There remains a need for novel archery bow structures that prevent benefits over existing designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a frame, a first limb assembly supporting a first rotatable member and a second limb assembly supporting a second rotatable member. The first rotatable member comprises a cam. A bowstring extends between the first rotatable member and the second rotatable member. A power cable is in communication with the cam. The first limb assembly has a width and a length, wherein the width is at least 26% of the length. In some embodiments, the width is at least 28% of the length.

In some embodiments, an archery bow comprises a frame and a first limb assembly supporting a first rotatable member. The first limb assembly defines a length and comprises a first limb segment and a second limb segment. The first limb segment has a first width and the second limb segment has a second width. The first rotatable member comprises a cam and the bow comprises a power cable in communication with the cam. A second limb assembly supports a second rotatable member. A bowstring extends between the first rotatable member and the second rotatable member. A sum of the first width and the second width equals at least 20% of the length.

In some embodiments, an archery bow comprises a frame and a first limb assembly comprising a first limb segment and a second limb segment. The first limb assembly supports a first rotatable member. The first limb assembly supports a pillow block and the pillow block supports the first rotatable member. The pillow block contacts the first limb segment and the second limb segment.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
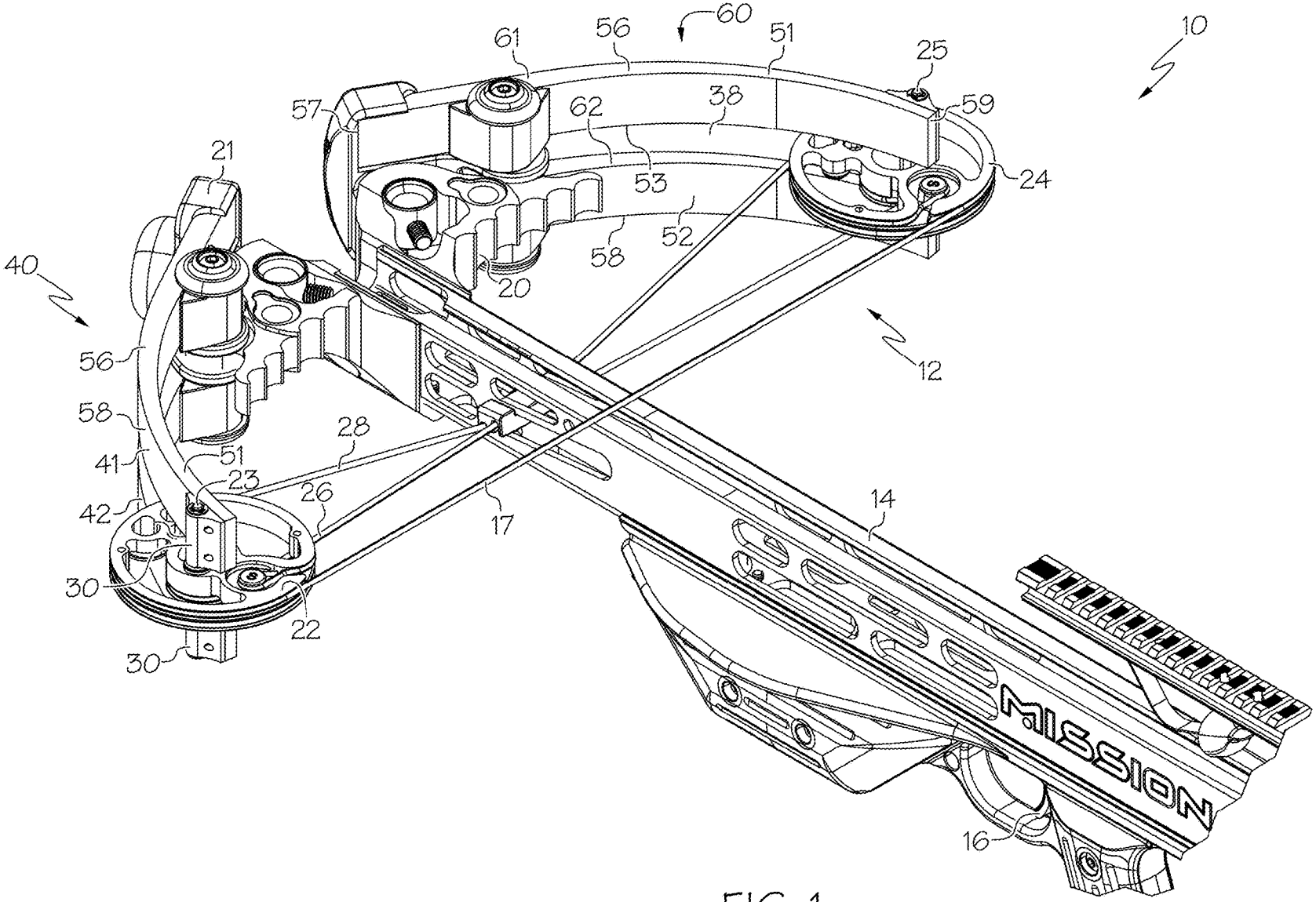
FIGS. 1-6 show an embodiment of a crossbow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10. In some embodiments, a crossbow 10 comprises a bow portion 12, a stock 14, a trigger 16 and a string catch.

In some embodiments, the bow portion 12 comprises a prod 20 arranged to support a first limb assembly 40 and a second limb assembly 60. In some embodiments, the prod 20 supports each limb assembly 40, 60 as a cantilever. In some embodiments, the first limb assembly 40 supports a first rotatable member 22. In some embodiments, the second limb assembly 60 supports a second rotatable member 24.

In some embodiments, the prod 20 supports a limb cup 21, and the limb cup 21 supports a limb assembly 40. In some embodiments, a limb cup 21 comprises features as disclosed in US 2017/0138691, the entire content of which is hereby incorporated herein by reference.

In some embodiments, the bow portion 12 comprises a bowstring 17, a first power cable 26 and a second power cable 28. In some embodiments, the rotatable members 22, 24 and cabling arrangement comprise features as disclosed in US 2016/014656, the entire content of which is hereby incorporated herein by reference. In some embodiments, the bow portion 12 comprises a two cam bow. In some embodiments, the bow portion 12 can be a single cam bow, a cam-and-a-half bow, etc.

In some embodiments, a limb assembly 40, 60 comprises a single limb member (not illustrated), and a single limb member supports a rotatable member 22, 24. In some embodiments, a single limb comprises a forked end having a slot, and a rotatable member 22 is positioned in the slot.

In some embodiments, the first limb assembly 40 supports a first axle 23, and the first axle 23 supports the first rotatable member 22. In some embodiments, the second limb assembly 60 supports a second axle 25, and the second axle 25 supports the second rotatable member 24. In some embodiments, a limb assembly 40 supports one or more pillow blocks 30, and the pillow blocks 30 support an axle 23.

In some embodiments, a limb assembly 40, 60 comprises a plurality of limb segments. In FIG. 1, the first limb assembly 40 comprises a first limb segment 41 and a second limb segment 42, and the second limb assembly 60 comprises a first limb segment 41 and a second limb segment 42. In some embodiments, the limb segments 41, 42 forming a limb assembly 40 collectively support a rotatable member 22.

In some embodiments, the first limb segments 41, 61 are located to a first side of an associated rotatable member 22, 24, and the second limb segments 42, 62 are located to a second or opposite side of the rotatable members 22, 24. In some embodiments, a bow portion 12 defines a shooting axis and/or the bowstring 17 defines a bowstring plane of travel. In some embodiments, the rotatable members 22, 24 are oriented in the bowstring plane of travel. In some embodiments, the first limb segments 41, 61 and the second limb segments 42, 62 are located on opposite sides of the bowstring plane of travel.

In some embodiments, a limb comprises at least 2 inches of width for each 10 inches of length. In some embodiments, a limb assembly 40 comprises at least 2 inches of width for each 10 inches of length.

In some embodiments, a limb comprises a width that is at least ⅕ of its length. In some embodiments, a limb assembly 40 comprises a width that is at least ⅕ of its length.

Limbs and limb assemblies having a high width to length ratio provide a greater amount of surface area on the tension surface and/or the compression surface than is provided by prior art limbs. The greater surface area allows for a reduced stress level and greater longevity.

Figure 2:
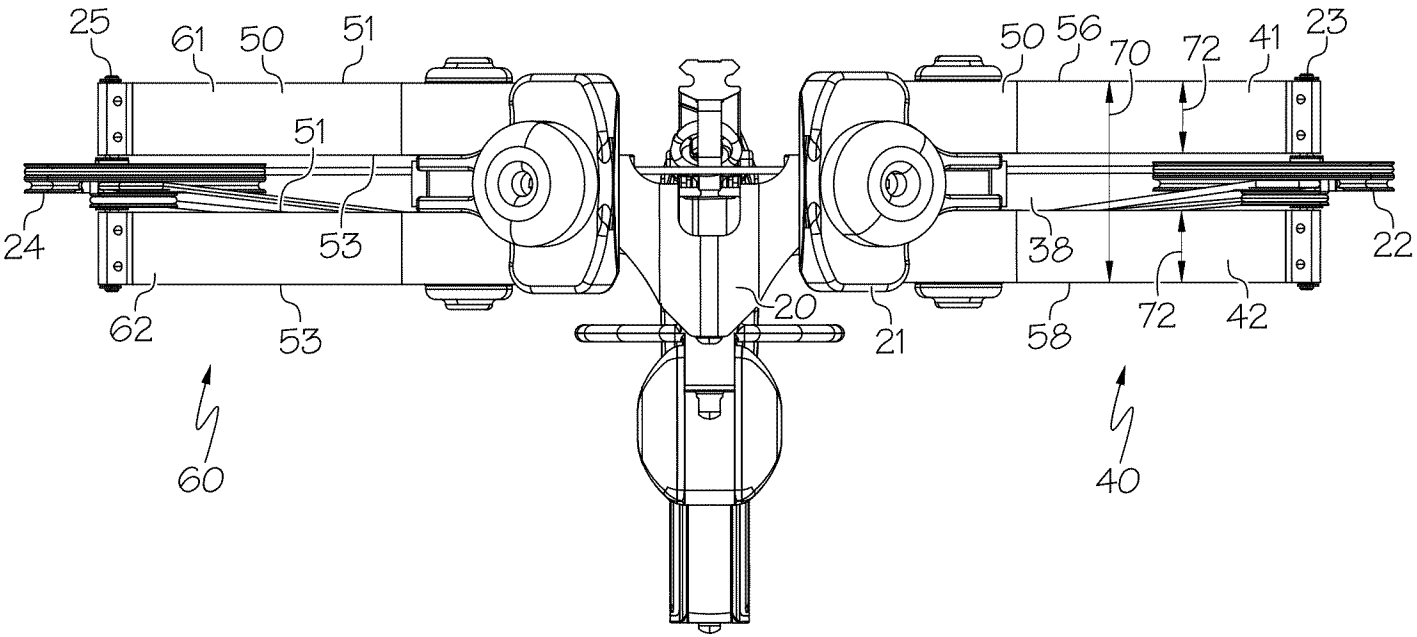
Figure 3:
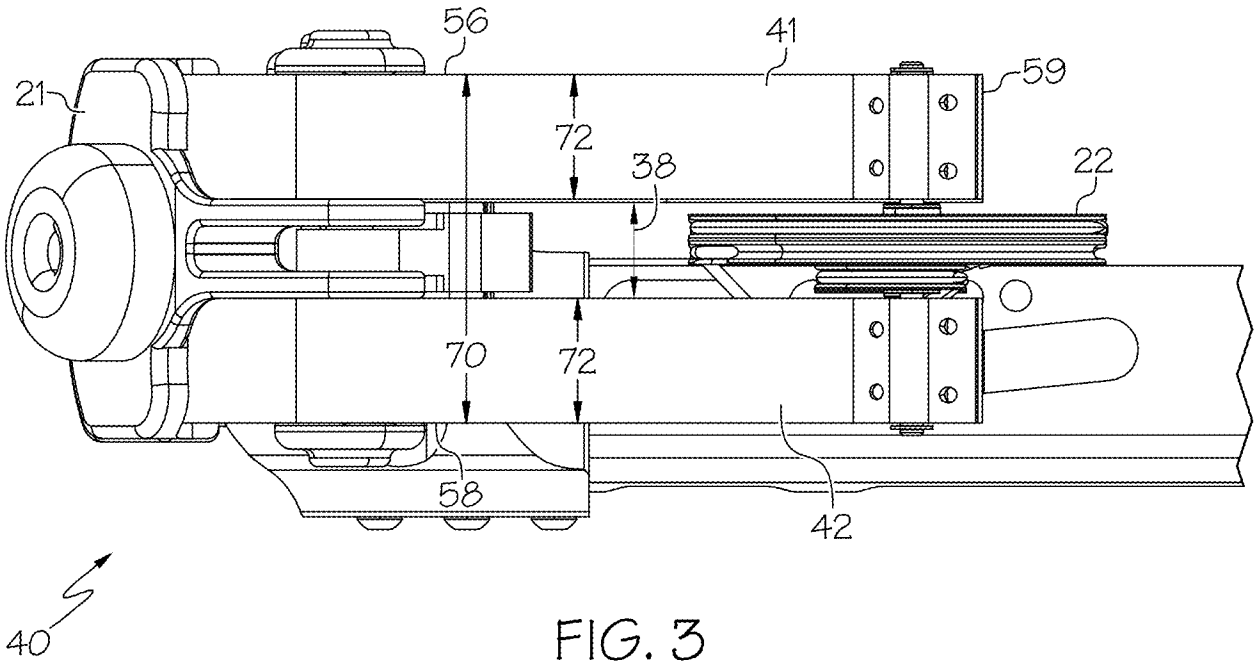
Figure 4:
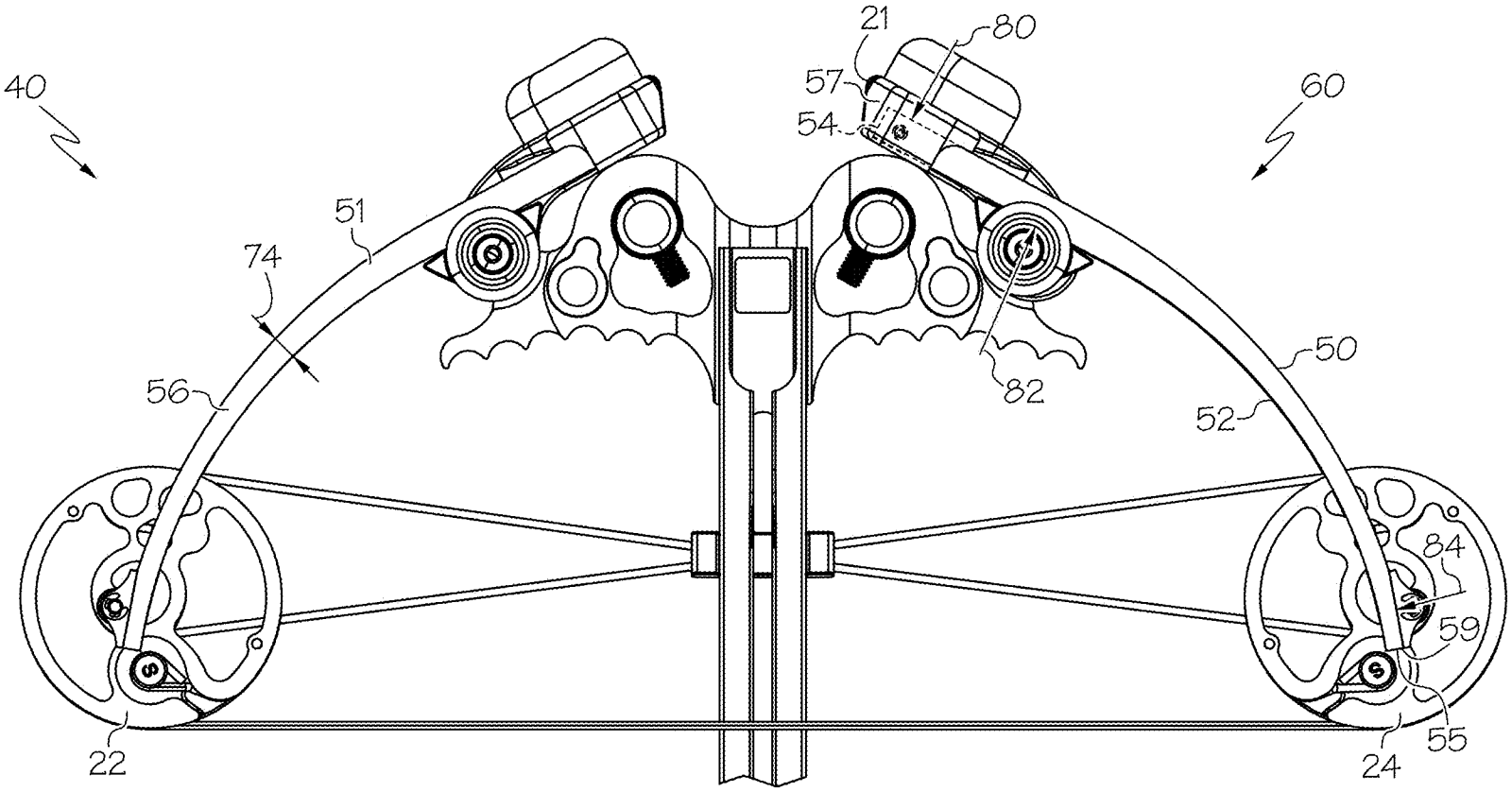
Figure 5:
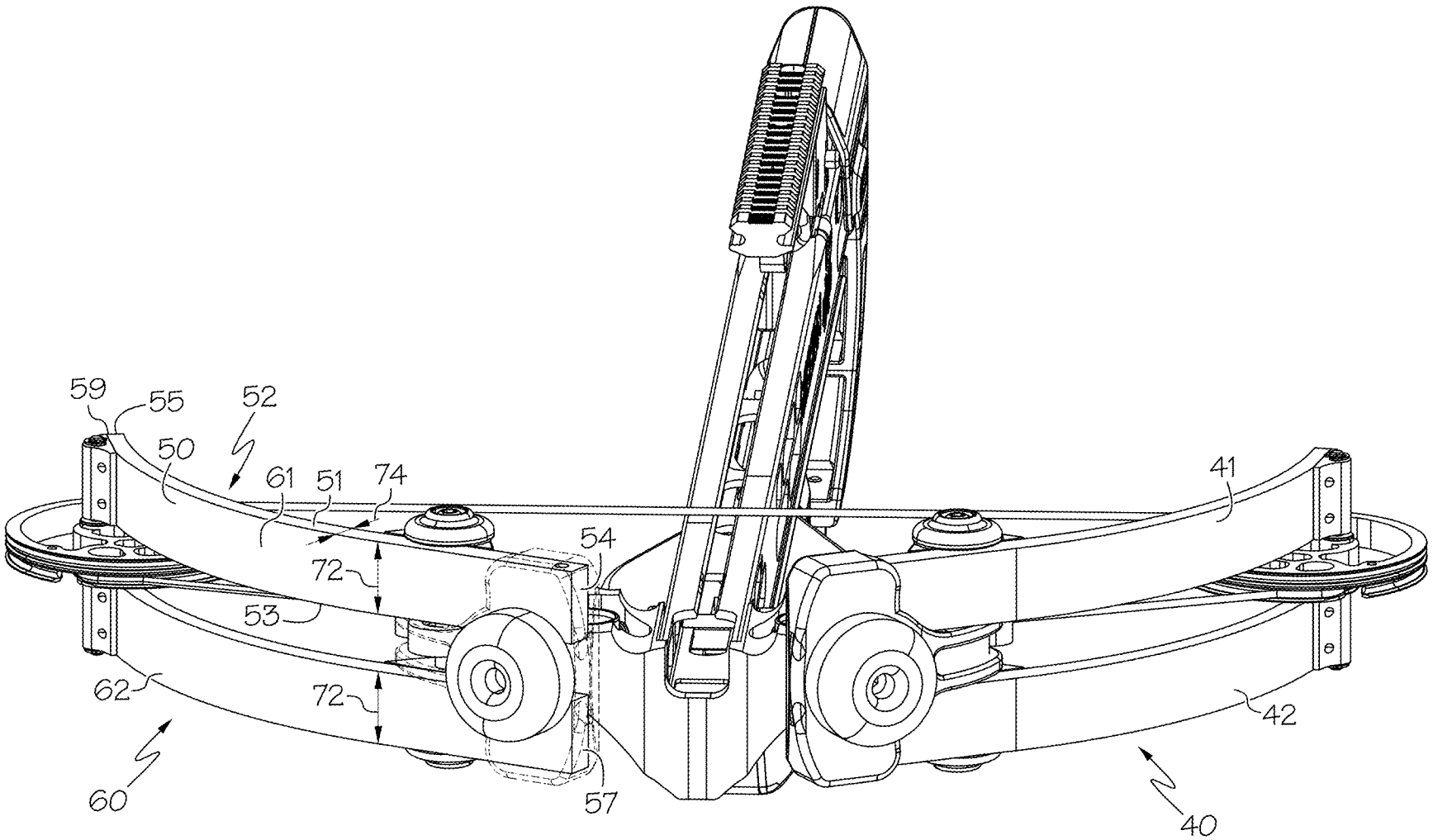
Figure 6:
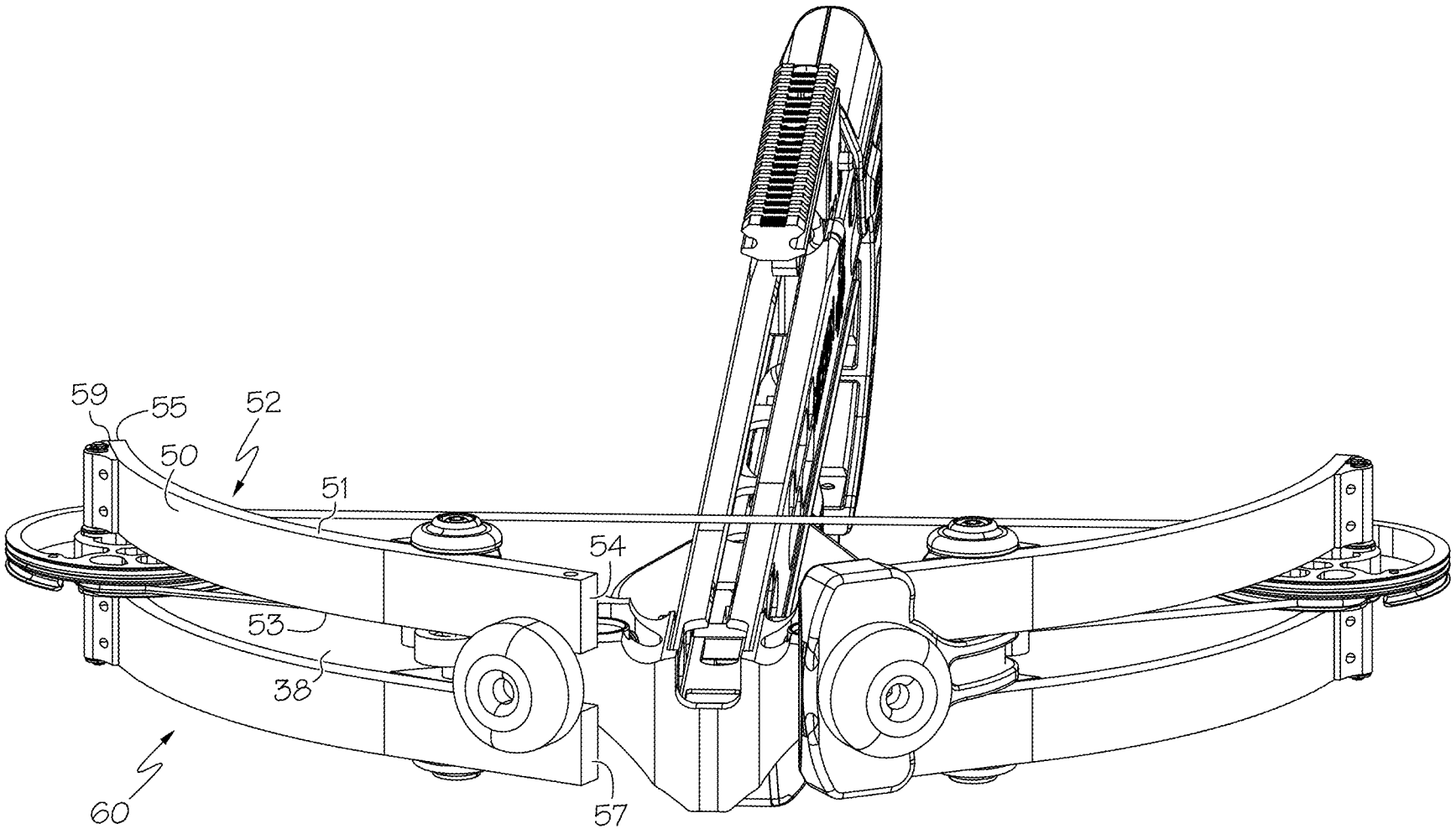

FIG. 2 shows a front view of an embodiment of a crossbow 10. FIG. 3 shows a side view, and FIG. 4 shows a top view of the crossbow 10 embodiment of FIG. 2. FIGS. 5 and 6 show angled front views of the crossbow 10 embodiment of FIG. 2. In FIGS. 4 and 5, a limb cup 21 is shown as transparent to better illustrate the limbs. In FIG. 6, the limb cup 21 is omitted.

Referring to FIGS. 1-6, in some embodiments, a limb assembly 40 comprises a plurality of limb segments 41, 42. In some embodiments, a first limb segment 41 is spaced apart from a second limb segment 42 by a gap 38.

In some embodiments, a limb assembly 40, 60 comprises a first outer side surface 56 and a second outer side surface 58. An overall width 70 of the limb assembly 40 comprises a distance from the first outer side surface 56 to the second outer side surface 58. The overall width 70 measurement can include structural limb segments 41, 42 and any gaps 38. Desirably, width dimensions are measured laterally across the limb, for example orthogonal to a longitudinal axis of the limb. In some embodiments, a width dimension is measured parallel to a rotation axis of the rotatable member 22 supported by the limb assembly 40.

In some embodiments, the first outer side surface 56 of a limb assembly 40 is parallel to the second outer side surface 58. In some embodiments, the first outer side surface 56 and second outer side surface 58 are nonparallel. In some embodiments, the overall width 70 of a limb assembly 40 can be considered the greatest width dimension of the limb assembly 40.

In some embodiments, a limb assembly 40 comprises a first end 57 and a second end 59. A length of the limb assembly 40 can be measured from the first end 57 to the second end 59, for example along a longitudinal axis of the limb assembly 40. In some embodiments, the length can be measured when the limb in an unstressed or unflexed condition. In some embodiments, the length of a limb assembly 40 can be considered the greatest length dimension of the limb assembly 40.

In some embodiments, an overall width 70 of a limb assembly 40, 60 is at least 25% of the length of the limb assembly 40, 60. In some embodiments, an overall width 70 of a limb assembly 40, 60 is at least 26% of the length of the limb assembly 40, 60. In some embodiments, an overall width 70 of a limb assembly 40, 60 is at least 27% of the length of the limb assembly 40, 60. In some embodiments, an overall width 70 of a limb assembly 40, 60 is at least 28% of the length of the limb assembly 40, 60. In some embodiments, an overall width 70 of a limb assembly 40, 60 is at least 29% of the length of the limb assembly 40, 60. In some embodiments, an overall width 70 of a limb assembly 40, 60 is at least 30% of the length of the limb assembly 40, 60.

In some embodiments, a limb assembly 40 comprises a plurality of limb segments e.g. 41, 42. In some embodiments, a limb segment 41 comprises a tension surface 50, a compression surface 52, a first side surface 51 and a second side surface 53. In some embodiments, a limb segment 41 comprises a first end 54 and a second end 55.

In some embodiments, the first side surface 51 of a limb segment 41 is parallel to the second side surface 53. In some embodiments, a second side surface 53 of one limb segment 41 is parallel to an adjacent first side surface 51 of another limb segment 42. In some embodiments, each side surface 51, 53 of each limb segment 41, 42 in a limb assembly 40 is parallel.

In some embodiments, each limb segment 41, 42 of a limb assembly 40 has the same length dimension. In some embodiments, each limb segment 41, 42 of a limb assembly 40 has the same width dimension.

In some embodiments, the limb segments 41, 42 forming a limb assembly 40 have different widths. In some embodiments, the limb segments 41, 42 forming a limb assembly 40 have different lengths.

In some embodiments, the width 72 of a limb segment 41 is at least 10% of the length of the limb segment 41.

In some embodiments, the tension side 50 surface area of a limb segment 41 comprises at least as many square units as the limb segment 41 comprises units of length. For example, if the limb segment 41 has a length of ten inches, the tension side 50 surface area of the segment is ten square inches or more.

In some embodiments, a collective sum of all of the width dimensions 72 of the plurality of limb segments 41 in a limb assembly 40 represents a total structural width of the limb assembly 40. In some embodiment, the collective sum of all of the width dimensions 72 of the plurality of limb segments 41 in a limb assembly 40 equals at least 20% of the length of the limb assembly 40. For example, if the limb assembly 40 has a length of ten inches, the collective sum of width dimensions of the limb segments 41 comprising the limb assembly 40 is at least two inches.

In some embodiments, a collective sum of all of the tension side 50 surface areas of the plurality of limb segments 41 in a limb assembly 40 represents a total tension side 50 surface area of the limb assembly 40. In some embodiment, the total tension side 50 surface area of the limb assembly 40 equals at least 20% of the length of the limb assembly 40. For example, if the limb assembly 40 has a length of ten inches, the total tension side 50 surface area of the limb assembly 40 is twenty square inches or more.

FIG. 4 shows a top view of a crossbow 10 embodiment. In some embodiments, a limb assembly 40 is supported by the prod 20 as a cantilever. In some embodiments, support for the limb assembly 40 is provided as a force couple comprising a tension side support force 80 and a compression side support force 82. In some embodiments, the tension side support force 80 and the compression side support force 82 are provided by a limb cup 21. In some embodiments, the limb assembly 40 supports the rotatable member 22, and the limb assembly 40 is subject to a loading force 84.

Although the actual support forces 80, 82 and loading forces 84 are typically applied as distributed loads, the Figures show equivalent point loading vectors for simplicity, as is common for engineering calculations.

In some embodiment, the collective sum of all of the width dimensions 72 of the plurality of limb segments 41 in a limb assembly 40 equals at least 18% of a distance between the tension side support force 80 and the loading force 84. In some embodiment, the collective sum of all of the width dimensions 72 of the plurality of limb segments 41 in a limb assembly 40 equals at least 19% of a distance between the tension side support force 80 and the loading force 84. In some embodiment, the collective sum of all of the width dimensions 72 of the plurality of limb segments 41 in a limb assembly 40 equals at least 20% of a distance between the tension side support force 80 and the loading force 84.

Figure 7:
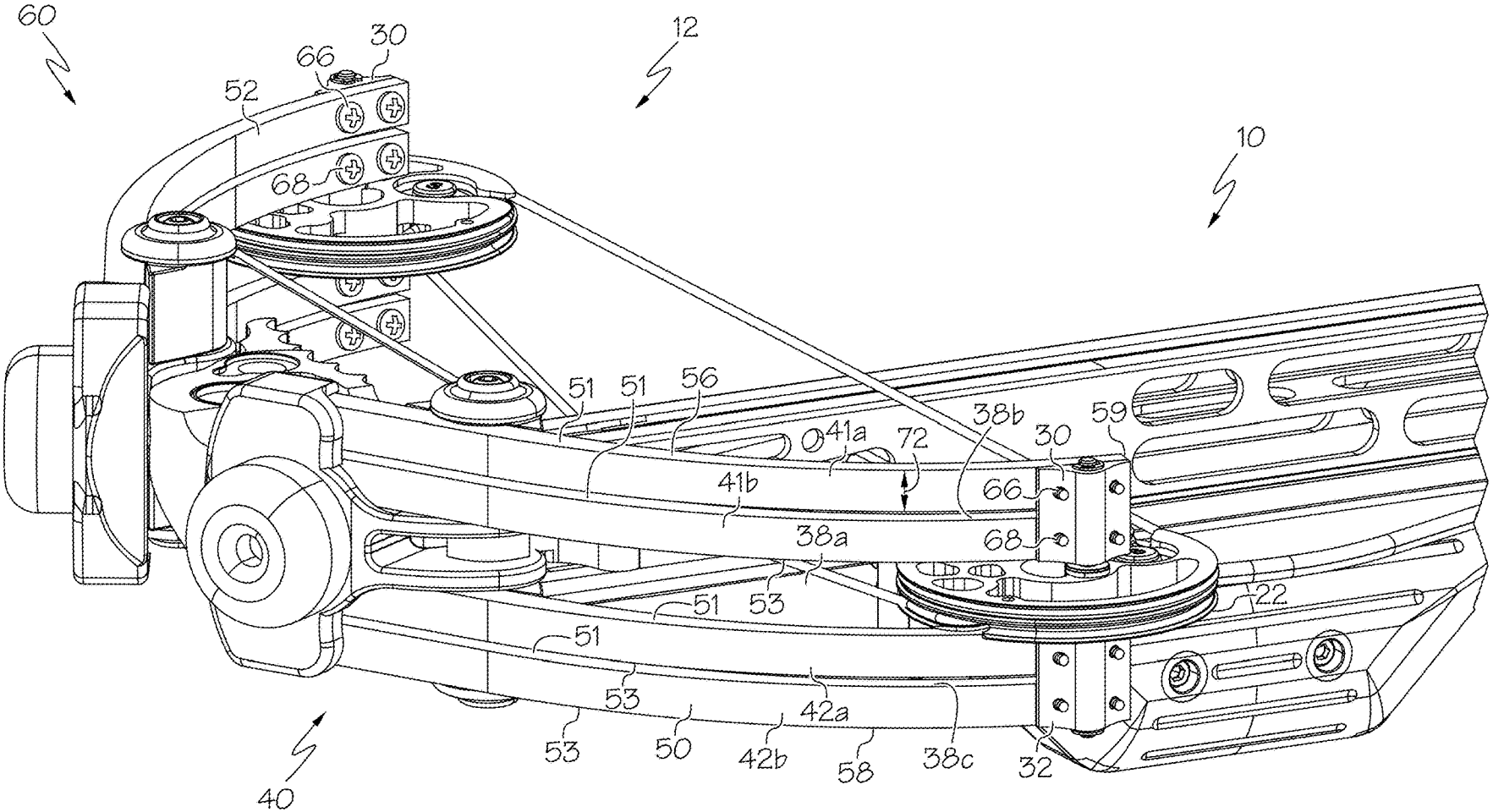
FIG. 7 shows another embodiment of a crossbow.

FIG. 7 shows another embodiment of a bow portion 12 having a wide limb ratio. In some embodiments, a limb assembly 40 comprises any suitable number of limb segments 41. The crossbow 10 of FIG. 7 comprises eight limb segments 41, wherein each limb assembly 40, 60 comprises four limb segments 41.

In some embodiments, a limb assembly 40 comprises a first limb segment 41*a* and a second limb segment 41*b* located to a first side of a rotatable member 22. In some embodiments, the limb segments 41*a*, 41*b* located to a common side of a rotatable member 22 are separated by a gap 38*b*. In some embodiments, a limb assembly 40 comprises a first limb segment 42*a* and a second limb segment 42*b* located to a second side of a rotatable member 22. In some embodiments, the limb segments 42*a*, 42*b* located to a common side of a rotatable member 22 are separated by a gap 38*c*.

In some embodiments, a collective sum of all of the width dimensions 72 of the plurality of limb segments 41*a*, 41*b*, 42*a*, 42*b* in a limb assembly 40 equals at least 20% of the length of the limb assembly 40.

In some embodiments, a collective sum of all of the tension side 50 surface areas of the plurality of limb segments 41*a*, 41*b*, 42*a*, 42*b* in a limb assembly 40 equals at least 20% of the length of the limb assembly 40.

In some embodiments, a pillow block 30 contacts multiple limb segments 41*a*, 41*b*. In some embodiments, a pillow block 30 is attached to multiple limb segments 41*a*, 41*b*, for example comprising a first fastener 66 engaging a first limb segment 41*a* and a second fastener 68 engaging a second limb segment 41*b*.

In some embodiments, a first pillow block 30 engages a first plurality of limb segments 41*a*, 41*b* of a limb assembly 40, and a second pillow block 32 engages a second plurality of limb segments 42*a*, 42*b* of the limb assembly 40. In some embodiments, the first pillow block 30 is located to a first side of the rotatable member 22, and the second pillow block 32 is located to a second side of the rotatable member 22.

Figure 8:
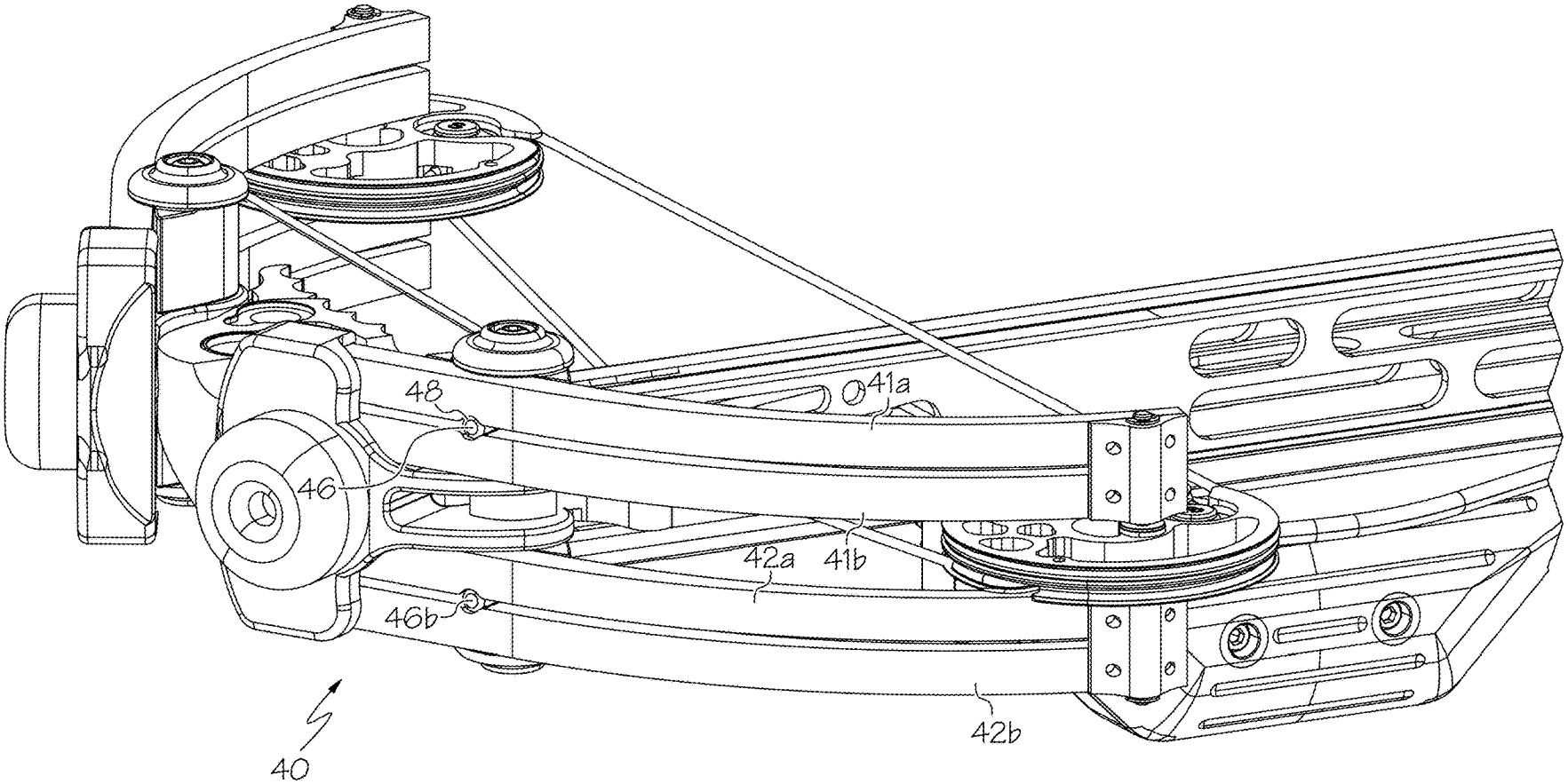
FIGS. 8-12 show another embodiment of a crossbow.
Figure 9:
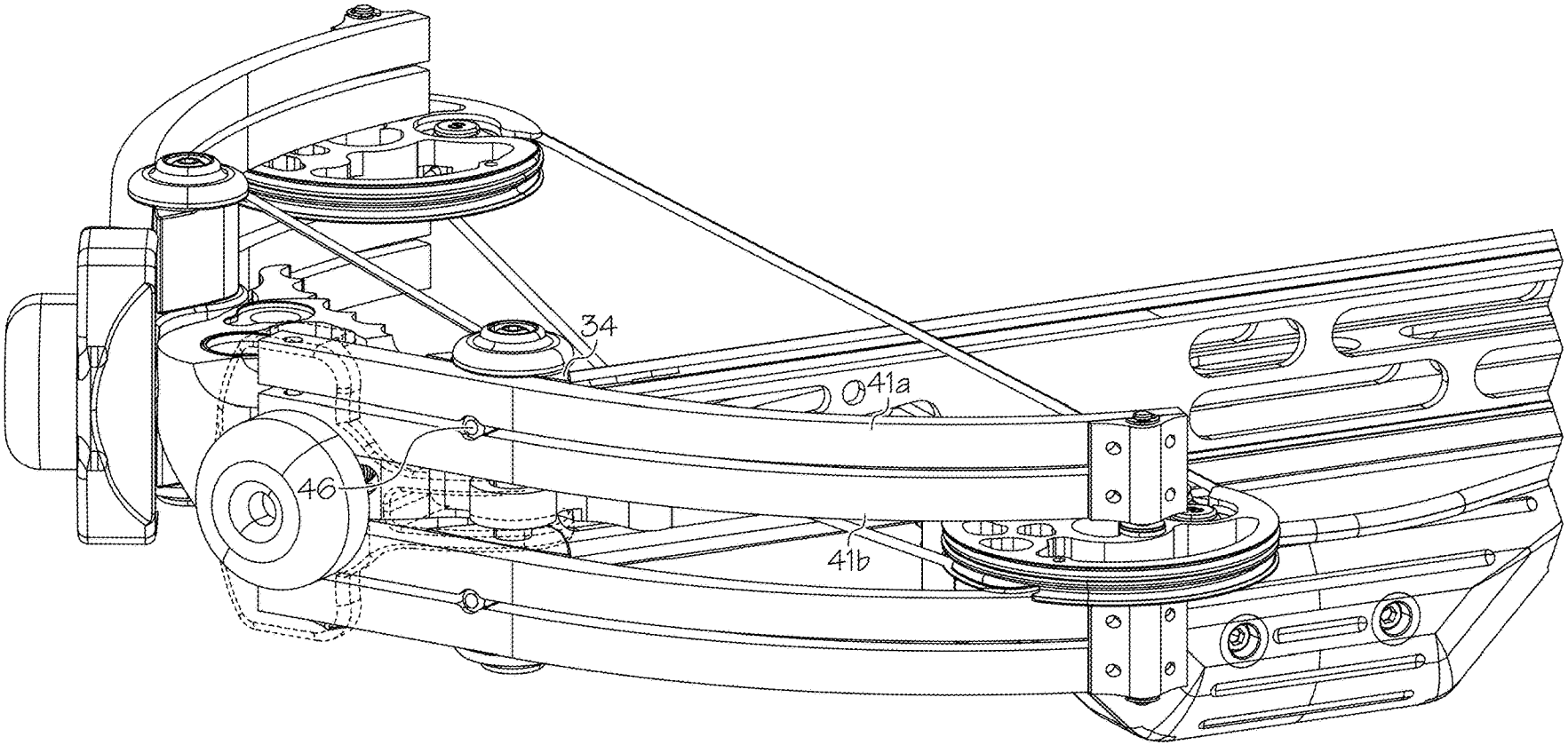
Figure 10:
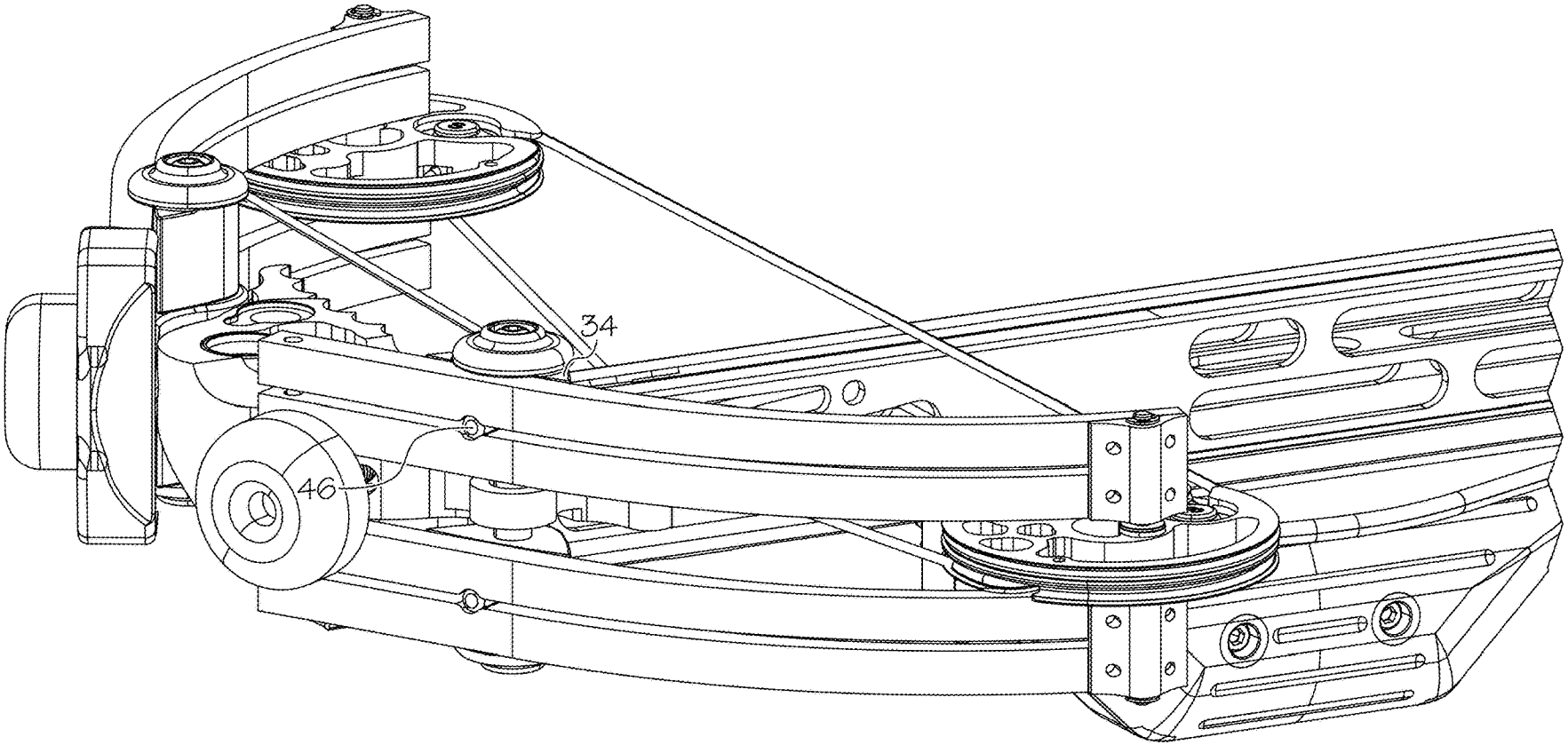
Figure 11:
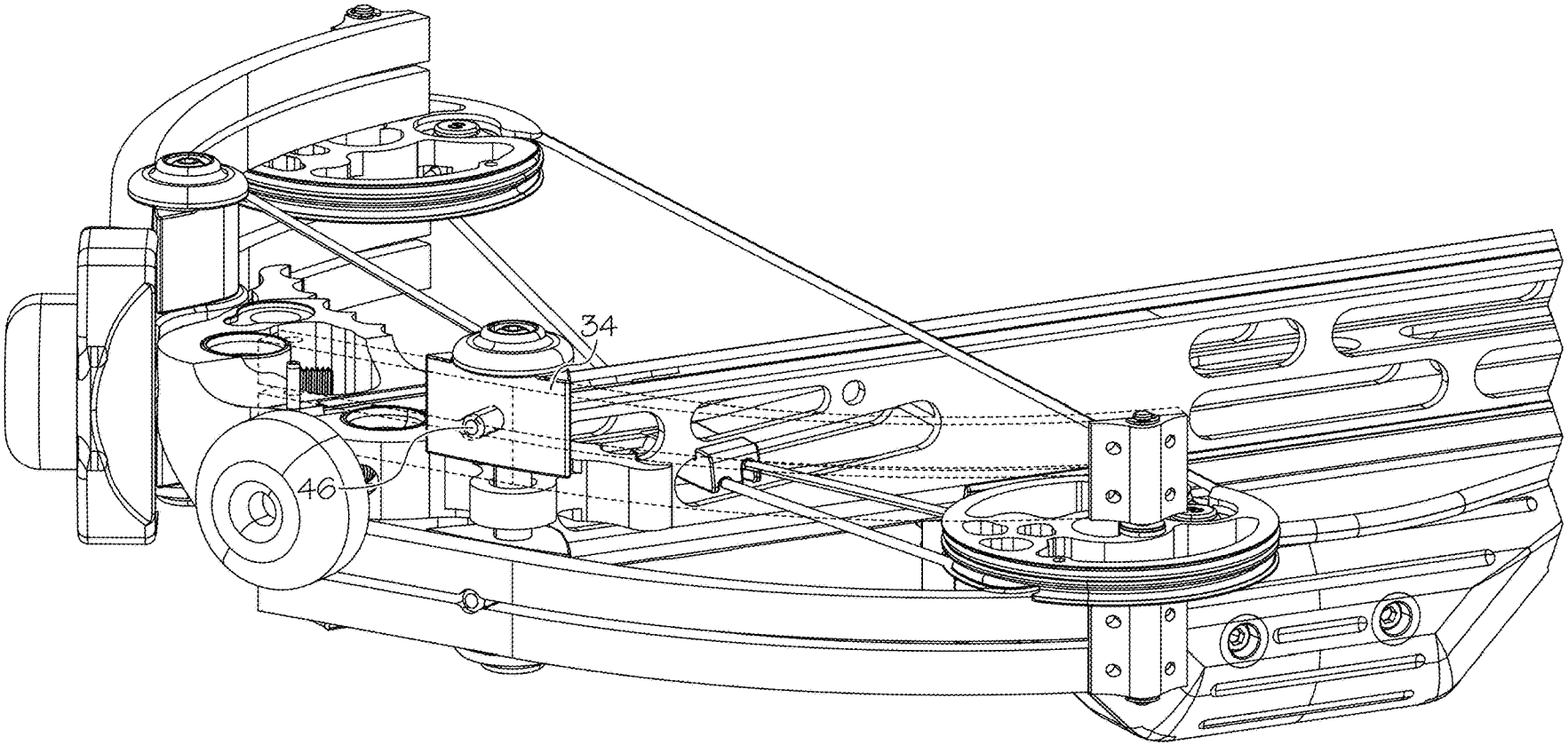
Figure 12:
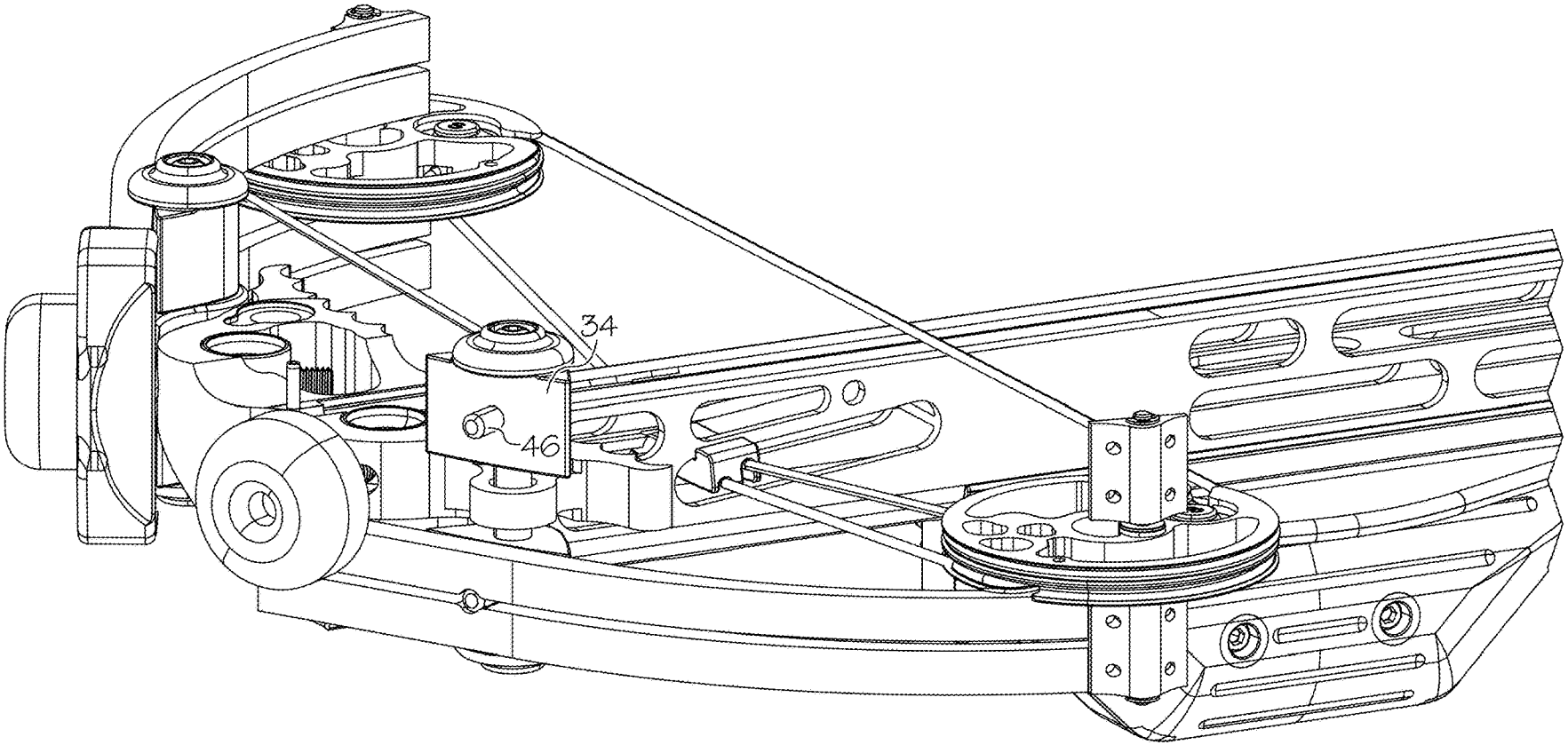

FIG. 8 shows another embodiment of a crossbow 10. In some embodiments, a crossbow 10 comprises a limb segment locator pin 46 in contact with at least one limb segment 41*a*. In some embodiments, a locator pin 46 in contacts multiple limb segments 41*a*, 41*b*.

In some embodiments, a limb segment 41*a*, 41*b* comprises a recess 48 for receiving a locator pin 46.

FIGS. 9-12 show additional views of the crossbow 10 of FIG. 8. In some embodiments, a crossbow 10 comprises a limb support pad 34. In some embodiments, the limb support pad 34 provides a compression side support force to a limb segment 41*a*. In some embodiments, a limb support pad 34 provides a compression side support force to a plurality of limb segments 41*a*, 41*b*.

Figure 13:
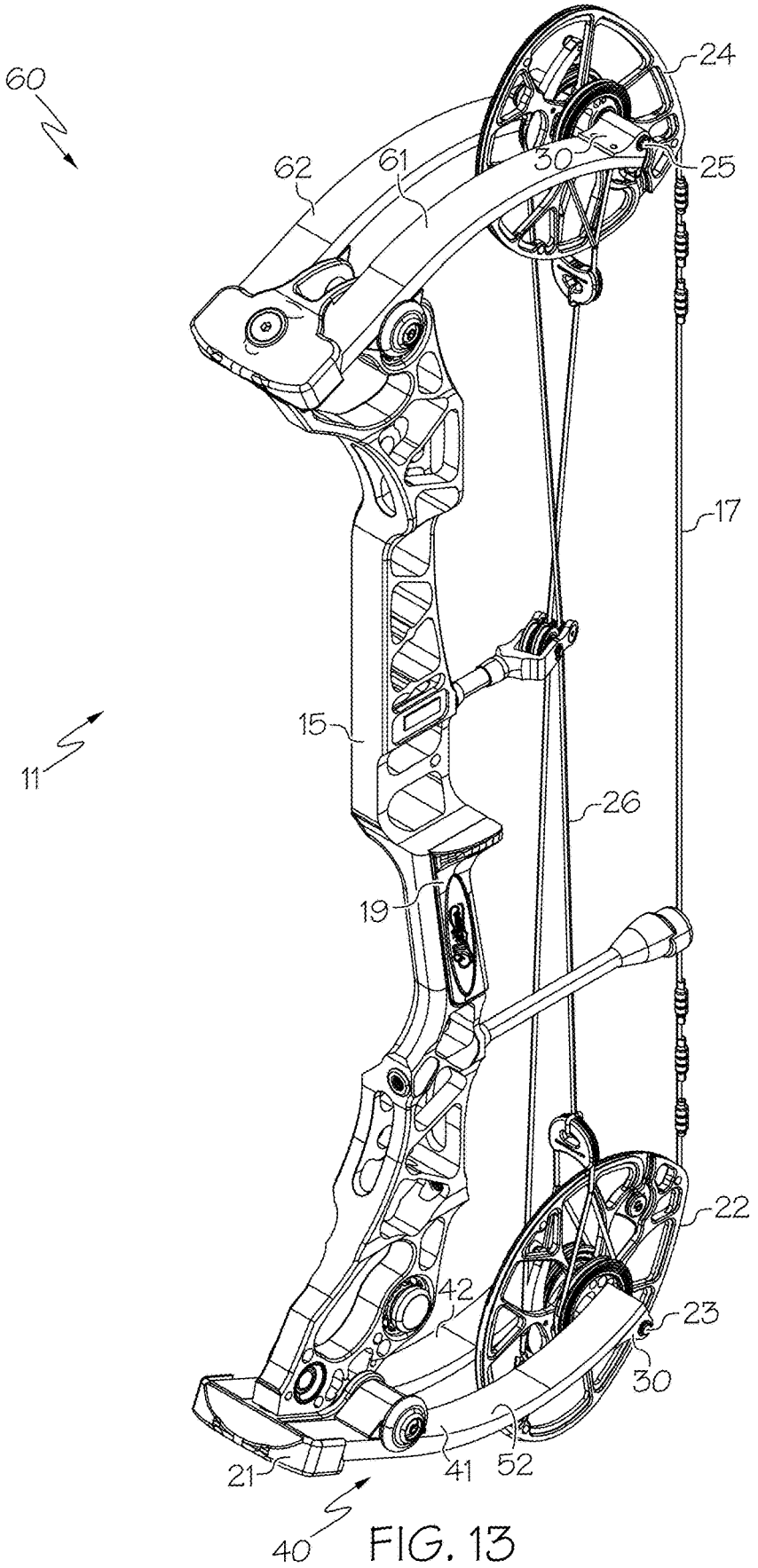
FIGS. 13 and 14 show an embodiment of an archery bow.
Figure 14:
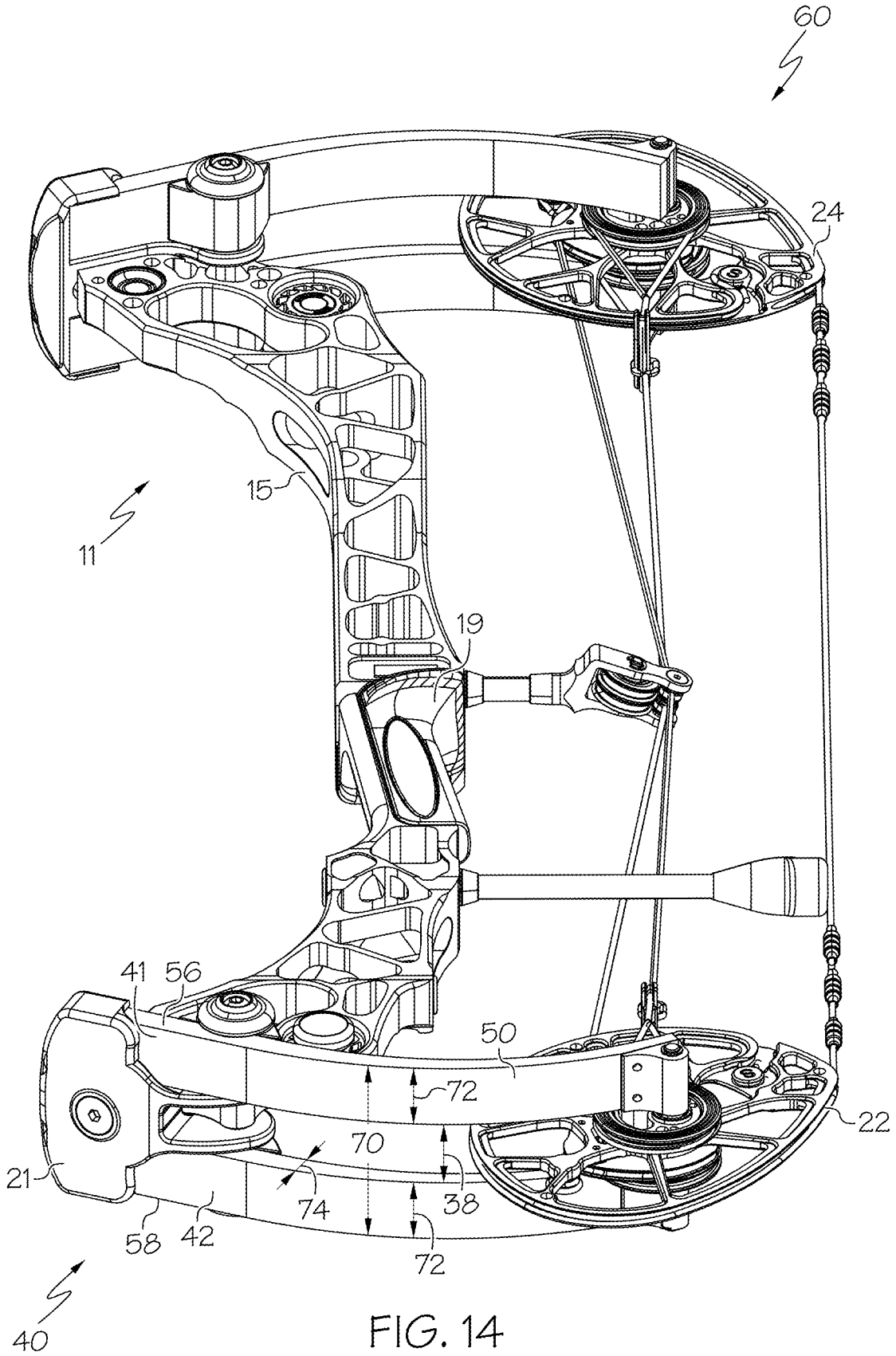

FIGS. 13 and 14 show an embodiment of an archery bow 11. In some embodiments, a bow 11 comprises a riser 15 arranged to support a first limb assembly 40 and a second limb assembly 60. In some embodiments, the riser 15 comprises a grip 19. In some embodiments, the riser 15 supports a limb cup 21, and the limb cup 21 supports a limb assembly 40.

The limb assemblies 40, 60 shown in FIGS. 13 and 14 can have the same features and sizing configurations as disclosed with respect to the embodiments shown in FIGS. 1-12. Like reference characters in the drawings indicate like features.

The limb width-to-length ratios described herein provide a wider limb structure for a given limb length than prior bows. The use of a wider limb allows the limb to be reduced in thickness while maintaining a similar total cross-sectional area. The reduced thickness increases stress levels located near the inner and outer surfaces (e.g. locations of highest respective compressive and tensile forces), while reducing the amount of material under low stress near the neutral axis of the limb. The wide limb ratio provides for greater efficiency by supporting a similar load using a limb that weighs less.

In some embodiments, an archery bow comprises:

a frame;

a first limb assembly supporting a first rotatable member, the first limb assembly comprising a length dimension, the first limb assembly comprising a plurality of limb segments, each limb segment having a width dimension;

the first rotatable member comprising a cam;

a second limb assembly supporting a second rotatable member;

a bowstring extending between the first rotatable member and the second rotatable member;

a power cable in communication with the cam;

wherein a sum of the width dimensions of the plurality of limb segments equals at least 20% of the length.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a prod, a stock, a string catch and a trigger;

a first limb assembly supporting a first rotatable member, the first rotatable member comprising a cam;

a second limb assembly supporting a second rotatable member;

a bowstring extending between the first rotatable member and the second rotatable member;

a power cable in communication with the cam;

the first limb assembly comprising a longitudinal axis, the longitudinal axis comprising curvature and excluding an inflection, the first limb assembly having a width and a length, wherein the width is at least 25% of the length.

2. The crossbow of claim 1, wherein the width is at least 28% of the length.

3. The crossbow of claim 1, wherein the first limb assembly comprises a first outer side and a second outer side, the width measured from the first outer side to the second outer side.

4. The crossbow of claim 1, wherein the width is measured in a direction parallel to a rotation axis of the first rotatable member.

5. The crossbow of claim 1, the first limb assembly comprising a first limb segment and a second limb segment.

6. The crossbow of claim 5, the first limb segment comprising a width and a length, wherein the width is at least 20% of the length.

7. A crossbow comprising:

a prod, a stock, a string catch and a trigger;

a first limb assembly supporting a first rotatable member, the first limb assembly comprising a length, the first limb assembly comprising a first limb segment and a second limb segment, the first limb segment having a first width, the second limb segment having a second width, the first limb segment comprising a longitudinal axis, the longitudinal axis comprising curvature and excluding an inflection;

the first rotatable member comprising a cam;

a second limb assembly supporting a second rotatable member;

a bowstring extending between the first rotatable member and the second rotatable member;

a power cable in communication with the cam;

wherein a sum of the first width and the second width equals at least 20% of the length.

8. The crossbow of claim 7, wherein the first limb assembly comprises a first outer side and a second outer side, wherein a total width measured from the first outer side to the second outer side is at least 25% of the length.

9. The crossbow of claim 7, wherein the first width and the second width are measured in a direction parallel to a rotation axis of the first rotatable member.

10. The crossbow of claim 7, the first limb assembly comprising a first end, the second limb assembly comprising a second end, the first rotatable member rotatable about a first axis, the second rotatable member rotatable about a second axis, a distance between the first axis and the second axis being greater than a distanced between the first end and the second end.

11. A crossbow comprising:

a prod, a stock, a string catch and a trigger;

a first limb assembly comprising a first limb segment and a second limb segment, the first limb segment comprising a longitudinal axis, the longitudinal axis comprising curvature and excluding an inflection, the first limb segment supporting a first pillow block, the second limb segment supporting a second pillow block, the first pillow block and the second pillow block supporting a first axle, the first axle supporting a first rotatable member;

a second limb assembly comprising a third limb segment and a fourth limb segment, the third limb segment supporting a third pillow block, the fourth limb segment supporting a fourth pillow block, the third pillow block and the fourth pillow block supporting a second axle, the second axle supporting a second rotatable member; and a bowstring extending between the first rotatable member and the second rotatable member;

the first limb assembly having a width and a length, wherein the width is at least 25% of the length.

12. The crossbow of claim 11, further comprising a limb pad arranged to support said first limb segment.

13. The crossbow of claim 12, the limb pad comprising a locator pin.

14. The crossbow of claim 13, the first limb segment comprising a recess, a portion of the locator pin oriented in the recess.

15. The crossbow of claim 11, comprising a first fastener attaching the first pillow block to the first limb segment.

16. The crossbow of claim 15, comprising a second fastener attaching the first pillow block to the first limb segment.

17. The crossbow of claim 15, the first fastener comprising a head and a threaded portion, the head abutting the first limb segment, the threaded portion engaging the first pillow block.

18. The crossbow of claim 11, the first limb assembly comprising a first end, the second limb assembly comprising a second end, a distance between the first axle and the second axle being greater than a distanced between the first end and the second end.

19. The crossbow of claim 11, comprising a first power cable in communication with the first rotatable member, the first power cable extending through the stock.

20. The crossbow of claim 19, comprising a second power cable in communication with the second rotatable member, the second power cable extending through the stock.

* * * * *